US005960515A

United States Patent [19]

Lu

[11] Patent Number: 5,960,515

[45] Date of Patent: Oct. 5, 1999

[54] HAIR COLLECTING DEVICE

[76] Inventor: Li-Chou Lu, No. 1, Lane 421, Chung Cheng Rd., Shin Chuang City, Taipei Hsien, Taiwan

[21] Appl. No.: 08/902,268

[22] Filed: Jul. 29, 1997

[51] Int. Cl.[6] ..... A47L 9/02

[52] U.S. Cl. ..... 15/415.1; 30/133; 119/600; 15/300.1

[58] Field of Search ..... 15/339, 314, 300.1, 15/415.1; 119/600; 30/133

[56] References Cited

U.S. PATENT DOCUMENTS

| | | | |
|---|---|---|---|
| D. 244,712 | 6/1977 | Houston | D30/40 |
| 825,961 | 7/1906 | Deckert . | |
| 2,780,829 | 2/1957 | Cohen | 15/365 |
| 3,816,858 | 6/1974 | Martin | 4/159 |
| 3,934,596 | 1/1976 | Sunthejmer et al. | 132/9 |
| 4,077,122 | 3/1978 | Rollor, Jr. et al. | 30/133 |
| 4,667,405 | 5/1987 | Trichell et al. | 30/41.5 |
| 5,095,853 | 3/1992 | Kruger | 119/85 |

*Primary Examiner*—David A. Redding
*Attorney, Agent, or Firm*—Rosenberg, Klein & Bilker

[57] ABSTRACT

A hair cleaning device is generally to maintain a barber shop's place by vacuum clean the cut hair. The device will suck all cut hair into a bag through either a vent attached on the trimmer or a bib sleeved onto a person's neck.

1 Claim, 10 Drawing Sheets

HAIR COLLECTING DEVICE

FIELD OF THE INVENTION

The present invention relates to hair collector and in particular to a device which collects hair and dandruff while trimming hair that will prevent the hair from flying in the air.

Many of the barbershop have hairs and dandruff will be spread all over the floor when cutting or trimming customers hair. Later on when they sweep the hair from the floor, hair will be floating in the air which, if inhaled, will damage to the health.

In view of this, the inventor has derived a hair trimmer which has a vacuum cleaner to suck cut hair into a collecting bag such that prevent hair from floating in the air.

SUMMARY OF THE INVENTION

It is the primary object of the present invention to provide a hair collecting device which includes a vacuum cleaner attached to the trimmer that sucks cut hair into a bag preventing hair from floating in the air.

It is another object of the present invention to provide a vacuum cleaner attached to a hair trimming device which suck the cut hair into a bag so that the room is kept clean all the time.

DETAILED DESCRIPTION OF THE PREFERRED EMBODIMENTS

Figure 1:
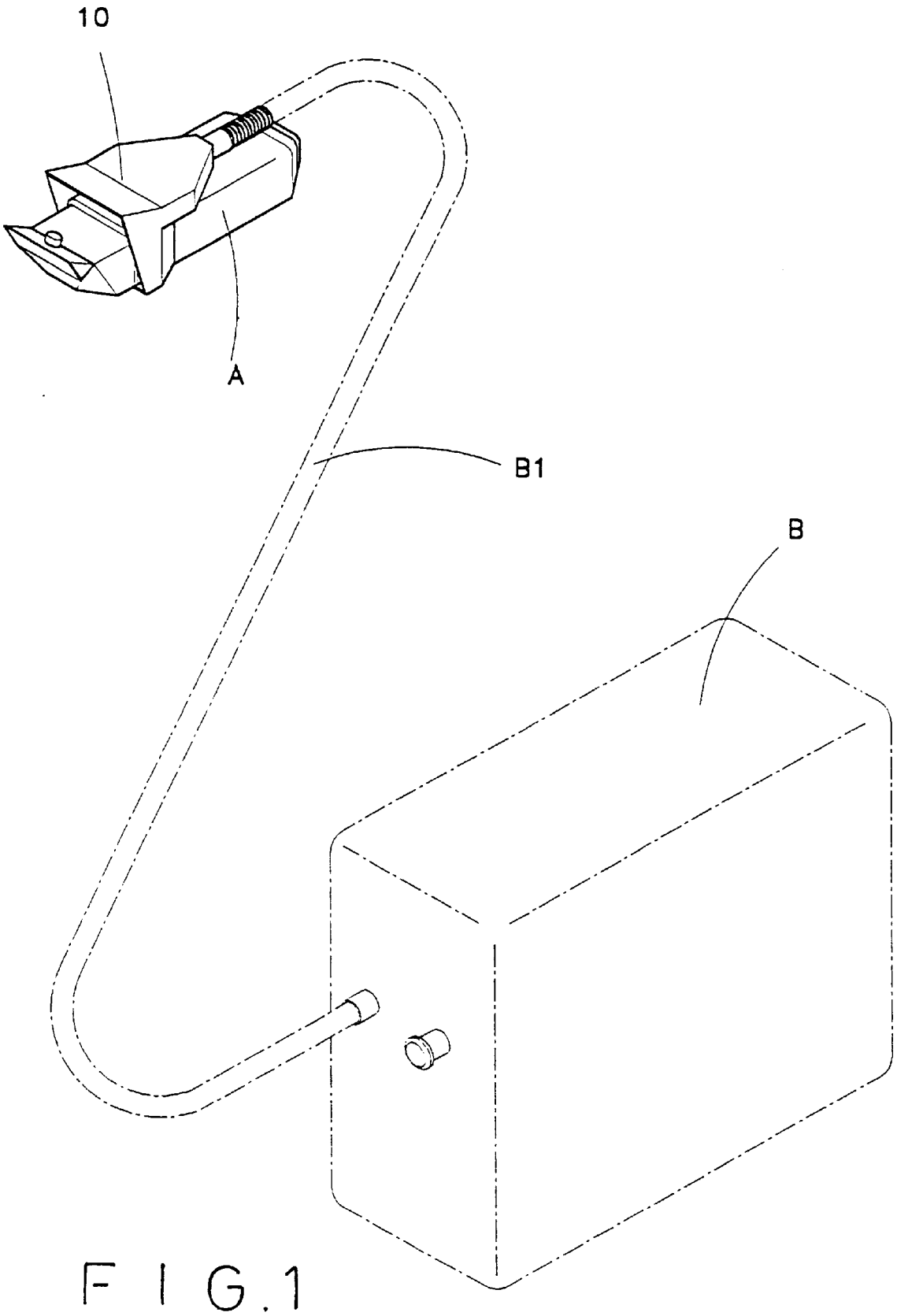
FIG. 1 is a perspective view of a trimming device equipped with a vacuum cleaner of the present invention.

Referring now made to the drawings in particular to FIG. 1, the trimmer A includes a vent 10 connected to a vacuum cleaner B through pipe B1.

Figure 2:
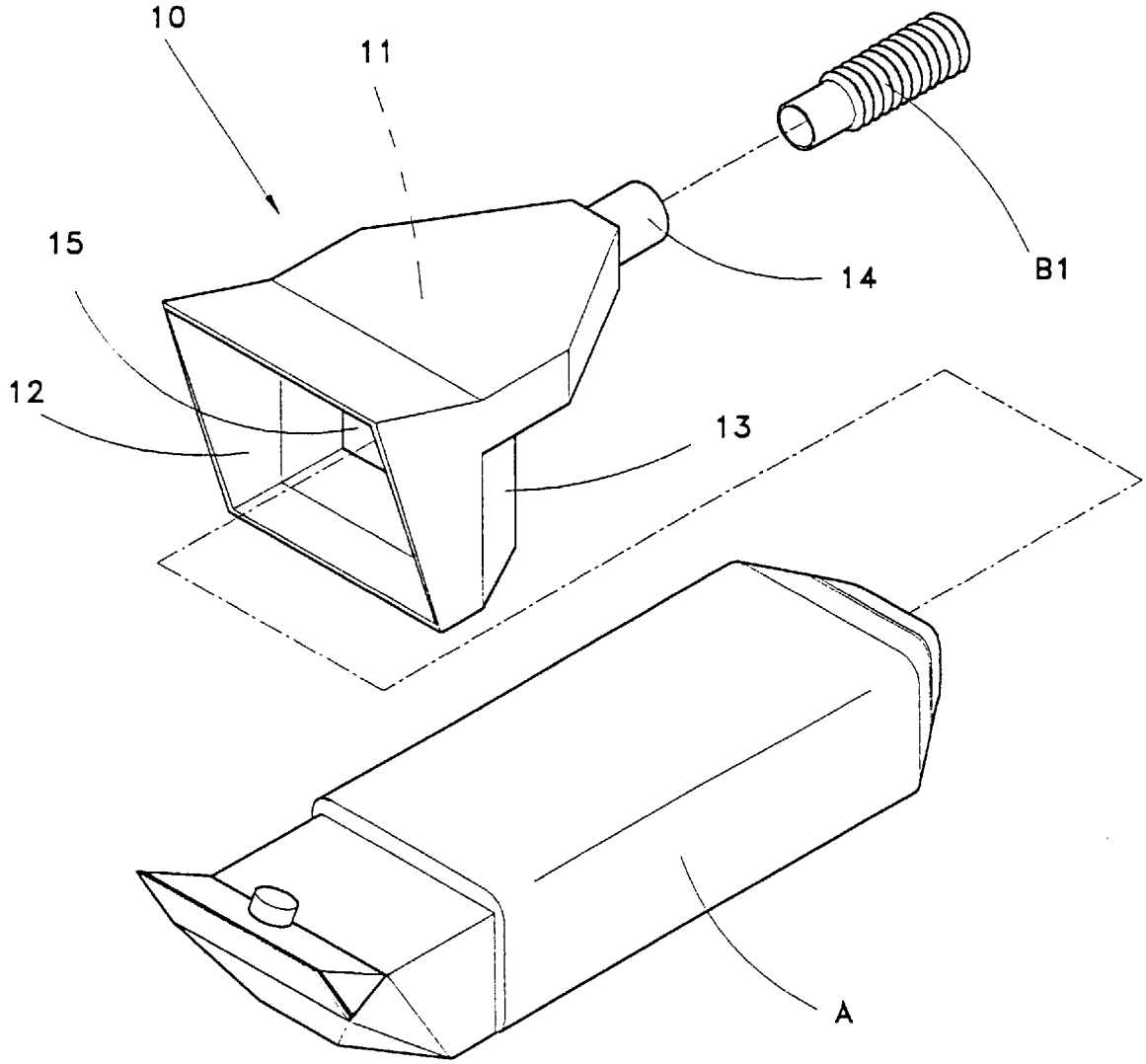
FIG. 2 is an exploded view of FIG. 1.
Figure 3:
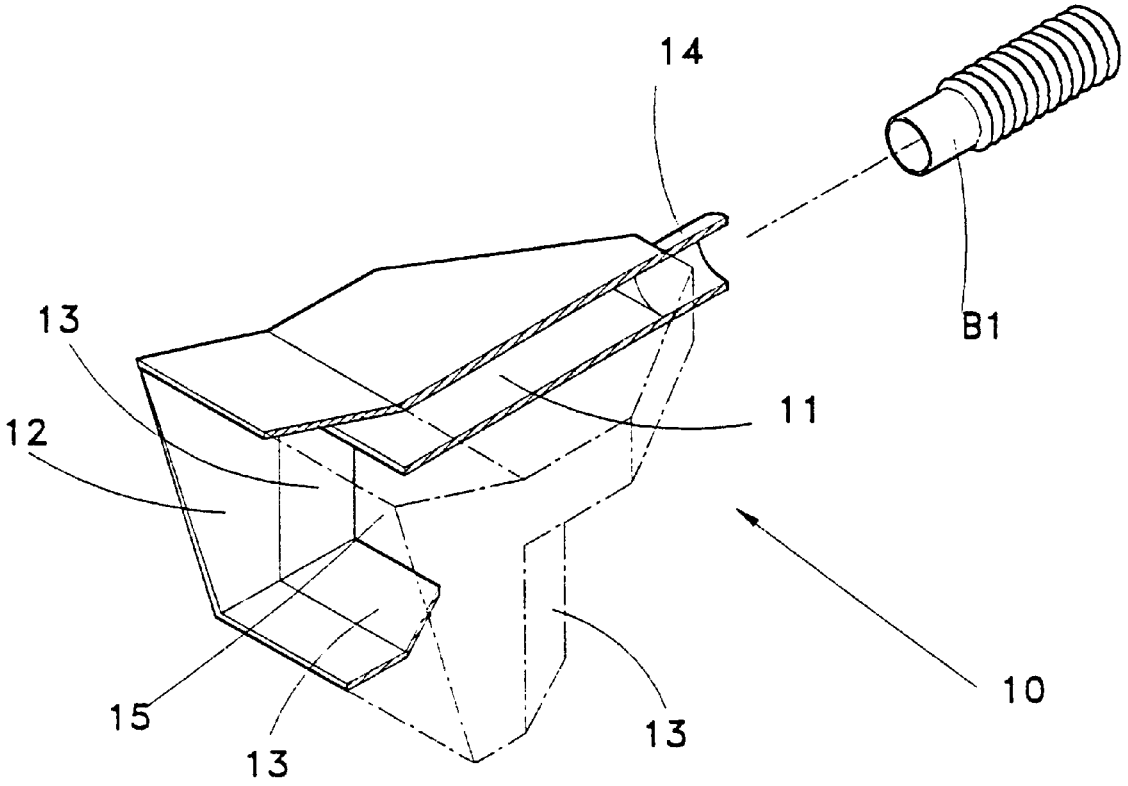
FIG. 3 is a perspective view of the vacuum cleaner, partially sectioned.

The vent 10, as shown in FIG. 2, has a big opening 12 at one end and a small opening 14 at the other end connected to the pipe B1, as shown in FIG. 3, forming a passage 11 at the inner portion. The inner portion of the big opening 12 has extending downward and inward forming a circular 15 defining four elastic strips 13.

Figure 4:
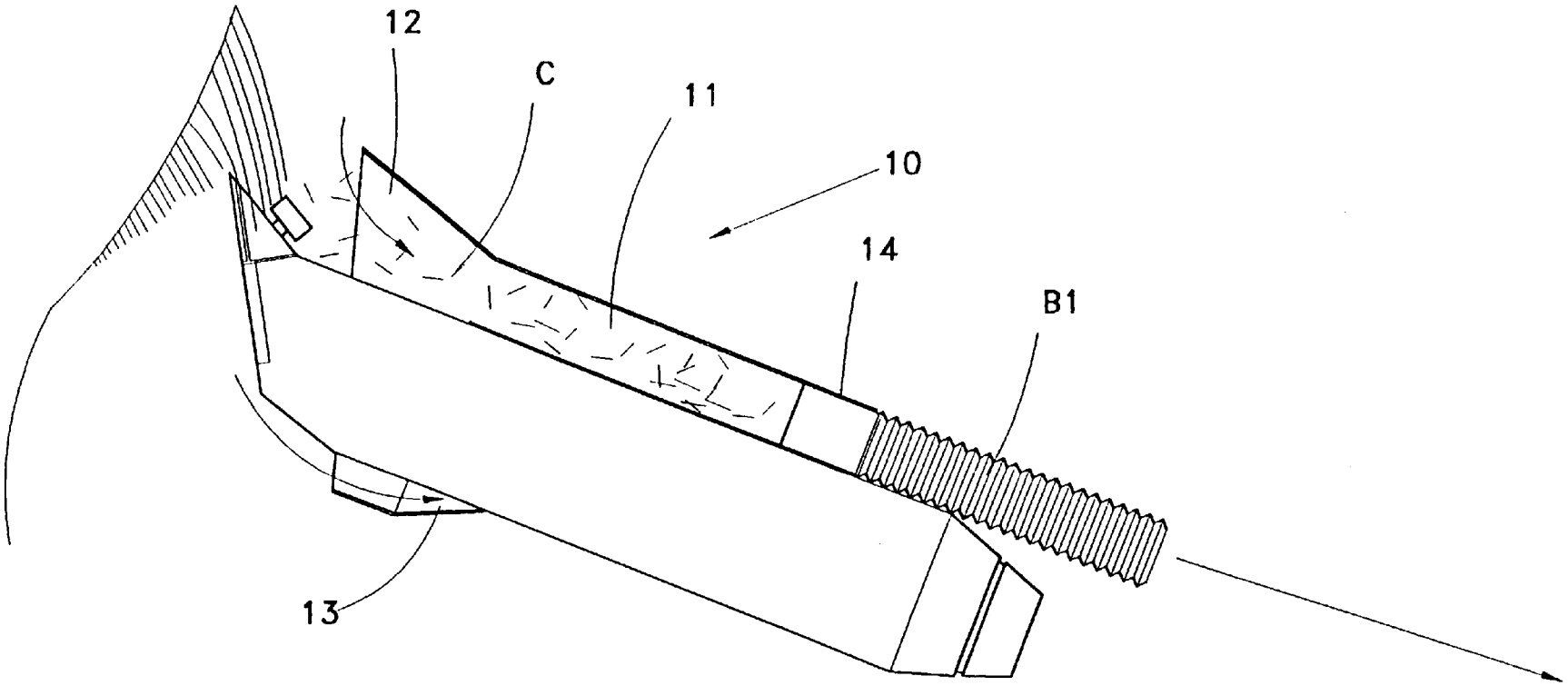
FIG. 4 is a side elevation view showing the trimming device trimming hair with the vacuum sucking hair simultaneously.

The connection is in such that sleeve the trimmer A into the vent 10 from the big opening end 12 and the elastic strips 13 will grasp the trimmer A securely. This ensure the vent 10 sucks the hair into the cleaner B through the pipe B1, as shown in FIG. 4.

Figure 5:
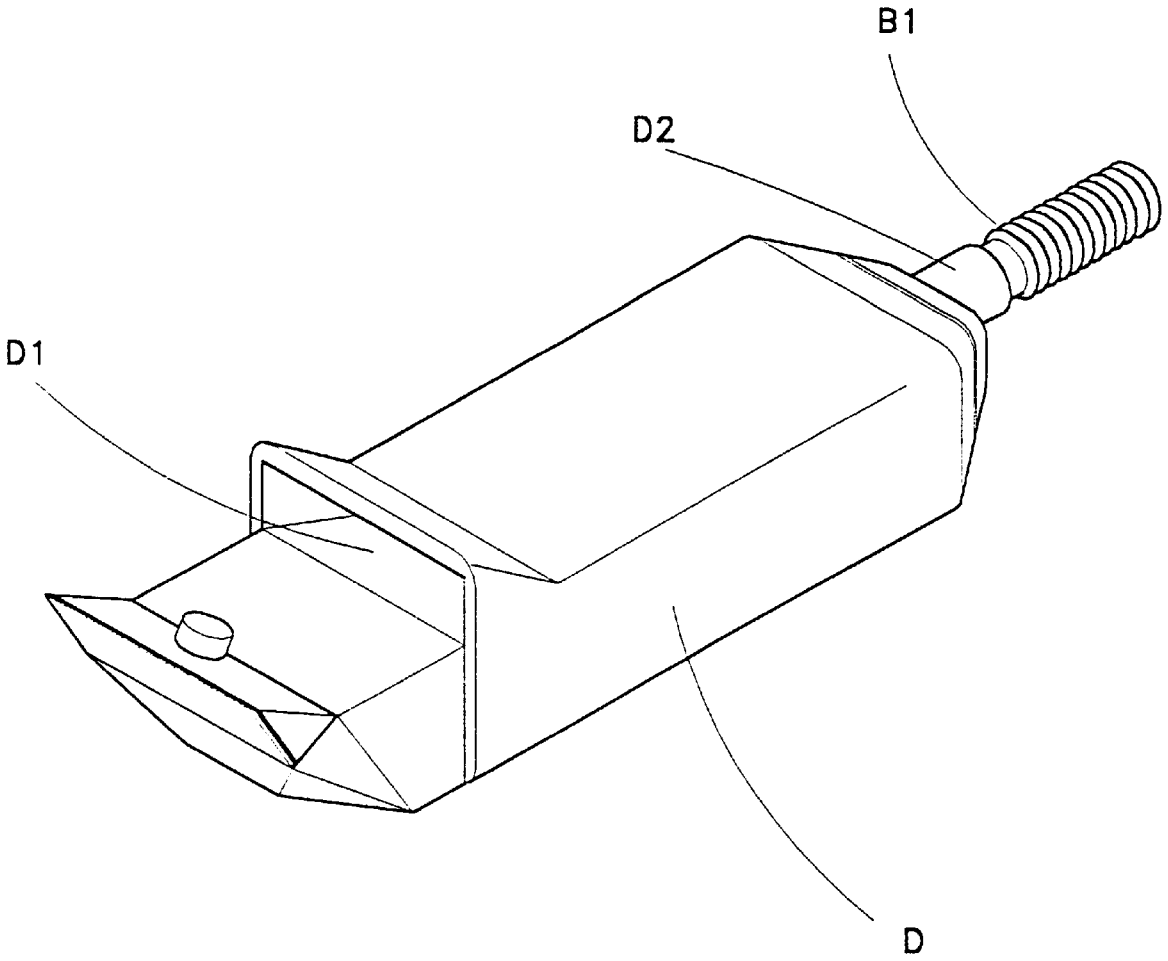
FIG. 5 is a perspective view of a second embodiment of the present invention.

FIG. 5 illustrates a second embodiment which has a vent D1 integral with the trimmer D and a small opening D2 connected to the pipe B1.

Figure 6:
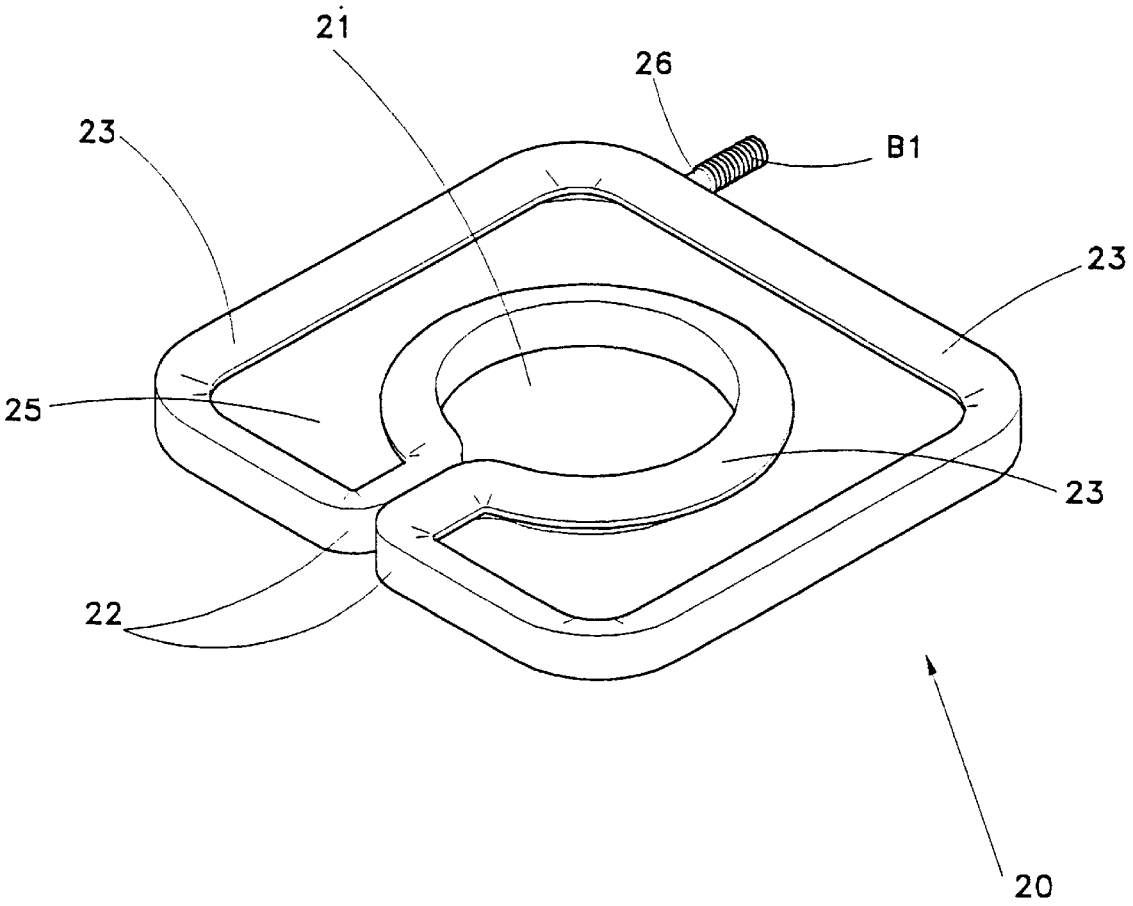
FIG. 6 is a perspective view of a bib of the present invention.
Figure 7:
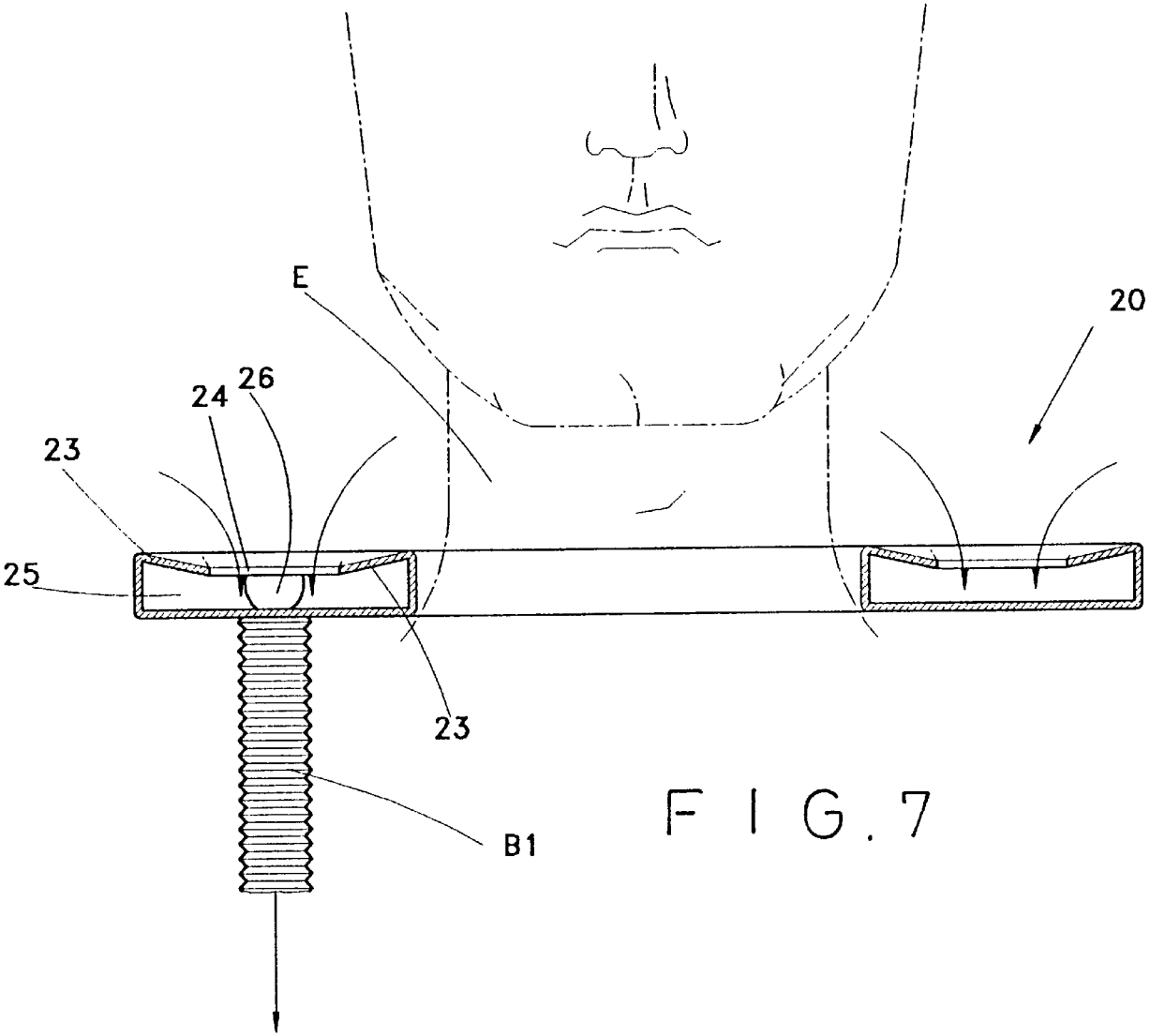
FIG. 7 is a front view showing the bib of FIG. 6 collecting cut hair.

FIG. 6 shows a bib 20 is made of soft material having a hole 21 at center portion for receiving the neck of a person to get haircut, an open end 22 which allows the bib 20 to spread open and slide into the hole 21, inclined surfaces 23 are formed on the outer edge and the inner edge of the hole 21, and a bottom portion 25 to collect hair. Upon cut hair dropped on the bottom portion 25, hair will be sucked into the pipe B1 through an aperture 24 and a tube 26, as shown in FIG. 7.

Figure 8A:
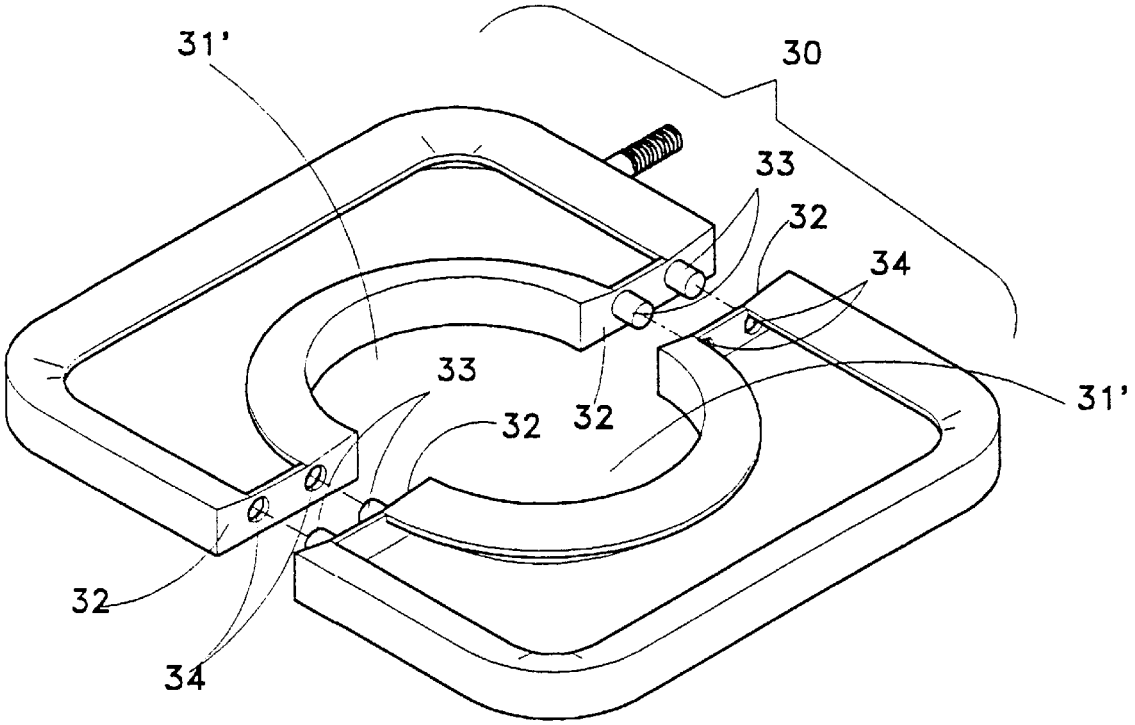
FIG. 8A is a second embodiment of a bib of FIG. 6, before assembled.
Figure 8B:
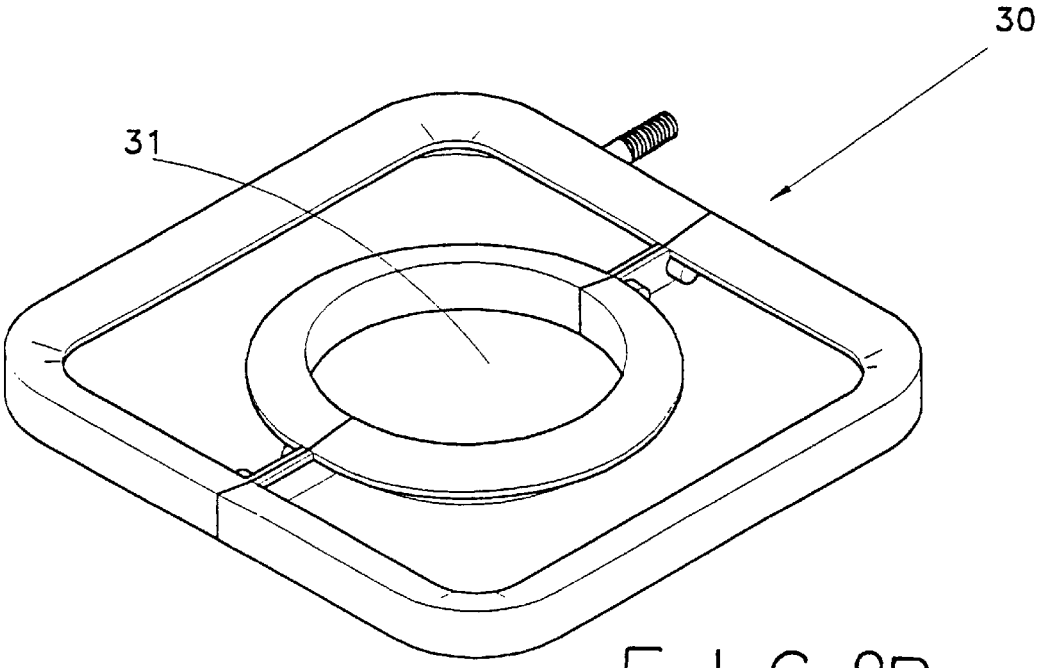
FIG. 8B is an identical view of FIG. 8A with the bib assembled.

Another embodiment of a bib 30 is formed as shown in FIG. 8A which is formed with two pieces of identical boards, each has a semi-circular recess 31' at middle of one side, two flat ends 32 with a pair of doweling jigs 33 at one end and a pair of dowels 34. When assemble the two pieces together, as shown in FIG. 8B, dowels 34 on one piece will be inserted into the doweling jigs 33 of the other piece, such forming an entire bib 30 with a hole 31 at center allowing the neck of a person therein.

Figure 9:
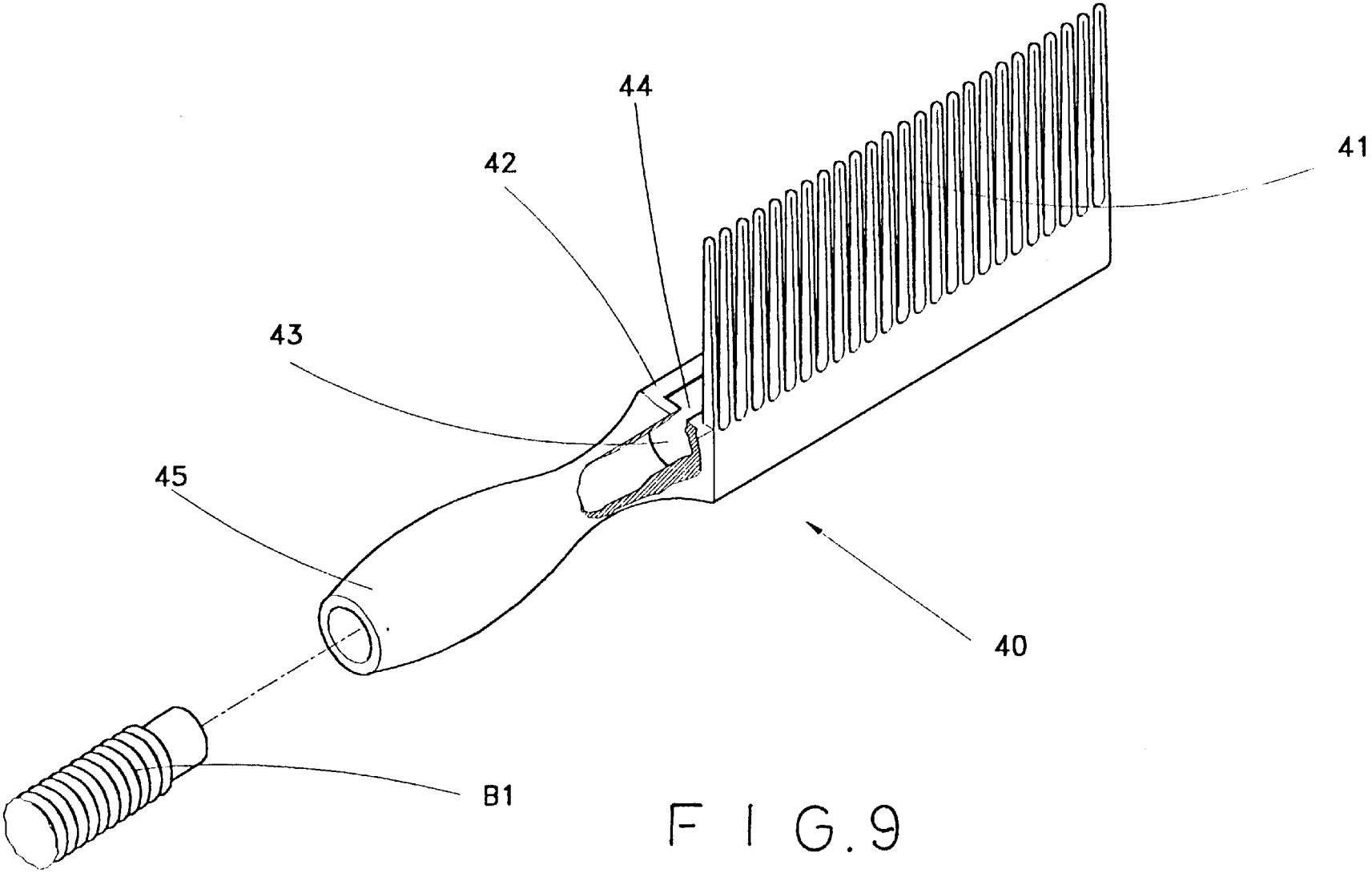
FIG. 9 is a perspective view of a comb of the present invention.
Figure 10A:
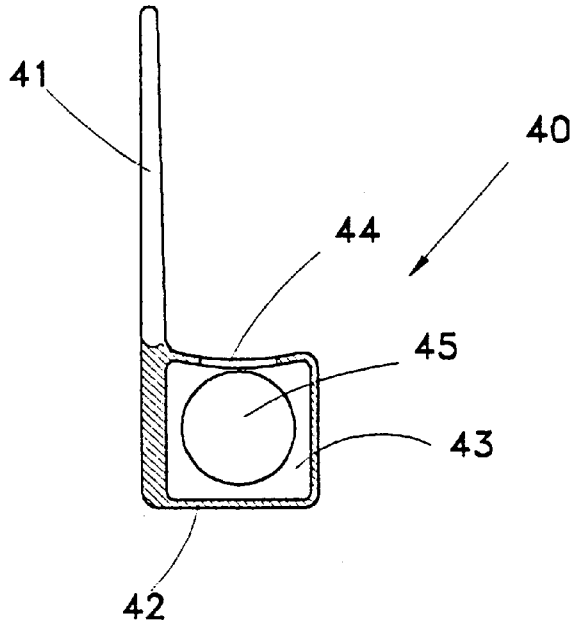
FIGS. 10A & 10B are two side section views showing the comb in operation.
Figure 10B:
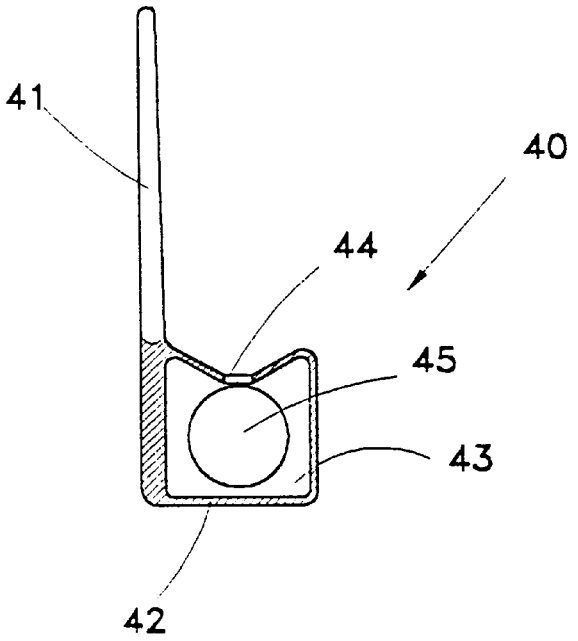

FIG. 9 is a third embodiment which shows a comb 40 having brushes 41 at one side seating on a comb body 42, an opening 43 forming at one end of a passage 43 extending longitudinal along the comb body 42 and is connected to the pipe B1 through knob 45. Whereas cut hair will be sucked into the pipe B1 through the passage 44 and the opening 43.

I claim:

1. A hair cleaning device comprising a bib having a hole at a center portion thereof for receiving a person's neck therein, and a tube located at one end of said bib for connection to a pipe, the improvements comprising:

said bib comprising two inclining surfaces respectively located on an outer edge of said bib and an edge of said hole, said bib further including two pieces of identical boards, each of said boards having a semi-circular recess formed at a middle portion thereof, a pair of flat cutting edges at respective ends thereof having a pair of dowels and doweling jigs on said edges respectively.

* * * * *